United States Patent [19]

Endo et al.

[11] 4,364,257

[45] Dec. 21, 1982

[54] ROTARY TRANSFER PRESS

[75] Inventors: Takuro Endo, Tokyo; Yukio Tomita, Osaka; Yukiro Okamoto, Nara; Hiroshi Imaoka, Nara; Michio Sakiyama, Nara, all of Japan

[73] Assignee: Hitachi Shipbuilding & Engineering Company Limited, Osaka, Japan

[21] Appl. No.: 168,288

[22] Filed: Jul. 10, 1980

[30] Foreign Application Priority Data

Jul. 2, 1979 [JP] Japan ..... 54-84184

[51] Int. Cl.[3] ..... B21J 13/08

[52] U.S. Cl. ..... 72/405; 72/419; 72/448; 72/450

[58] Field of Search ..... 72/405, 450, 421, 448, 72/446, 455, 419

[56] References Cited

U.S. PATENT DOCUMENTS

| | | | |
|---|---|---|---|
| 2,102,842 | 12/1937 | Glasner | 72/450 |
| 2,185,096 | 12/1939 | Treer | 72/446 |
| 2,831,423 | 4/1958 | Hautau | 72/448 |
| 3,134,350 | 5/1964 | Danly | 72/446 |
| 3,241,351 | 3/1966 | Hautau | 72/446 |
| 3,371,515 | 3/1968 | Munschauer | 72/446 |

*Primary Examiner*—Gene Crosby

*Attorney, Agent, or Firm*—Joseph W. Farley

[57] ABSTRACT

A rotary transfer press comprising a crown, a bed, a post extending from the bed to the crown, a slide upwardly and downwardly movable as guided along the post, a drive assembly for moving the slide upward and downward, a plurality of working stations disposed in a circular arrangement and each provided with a press die, and a transport assembly for transferring workpieces from each of the stations to the next station in succession. The press can be installed in a small space, and the workpieces are feedable to and dischargeable from the press at any of the stations. The press dies are also replaceable at any station.

7 Claims, 9 Drawing Figures

ROTARY TRANSFER PRESS

The present invention relates to a rotary transfer press, and more particularly to a rotary transfer press having stations in a circular arrangement for feeding, discharging and working workpieces.

Transfer presses have been proposed in which blanks are subjected to a sequence of press works while being transferred from one station to another intermittently in succession along a straight path of transport. The presses of this type have a relatively large length along the path of transport, at one end of which blanks are fed to the press, and the finished articles are discharged from the press at the other end of the path. Accordingly the installation of such presses involves limiting factors and requires a sufficient space. Additionally the press must be adapted for the replacement of the dies so that the machine can be changed over from the production of one lot of articles to the production of another lot of different articles.

In view of the above problems heretofore encountered, the main object of the invention is to provide a transfer press which can be installed in a limited space and which is capable of performing a sequence of press works efficiently, the transfer press being adapted to receive blanks at a station in the desired position and discharge the finished articles from any desired station.

To filfull this object, the present invention provides a rotary transfer press comprising a bed, a post extending upward from the bed, a slide upwardly and downwardly movable as guided along the post, a vertically driving assembly for moving the slide upward and downward, a plurality of working stations disposed in a circular arrangement and each provided with a die for a press work, and a transport assembly for transferring workpieces from each of the stations to the next station in succession.

According to a preferred embodiment of the invention, the transport assembly comprises an annular feed bar extending in the vicinity of the plurality of working stations, workpiece holders mounted on the feed bar, and a feed bar drive mechanism for intermittently reciprocally turning the feed bar through a specified angle, whereby workpieces can be transferred from each of the working stations to the next station in succession smoothly and properly. When the workpiece is progressively processed and deformed at the individual stations, it would be difficult to grip the workpiece with the same holder continually during the sequence of operations. In such a case it is very advantageous to drive the feed bar intermittently reciprocally.

Further according to the preferred embodiment, an annular guide path is provided on the bed to extend through the working stations, and the press die is mounted on a wheeled bolster which is movable along the annular guide path. With this arrangement, the press die can be easily removed or installed for replacement at any desired station.

As already stated, blanks can be fed, the finished articles can be discharged and the press dies are replaceable, all at any desired station according to the present invention, while the press can be installed in a small space, so that the installation of the press itself, as well as the arrangement of other machines associated therewith, involves substantially no limitations, hence very advantageous.

Various other features and advantages of the invention will become apparent from the following description of the preferred embodiments with reference to the accompanying drawings, in which.

Figure 1:
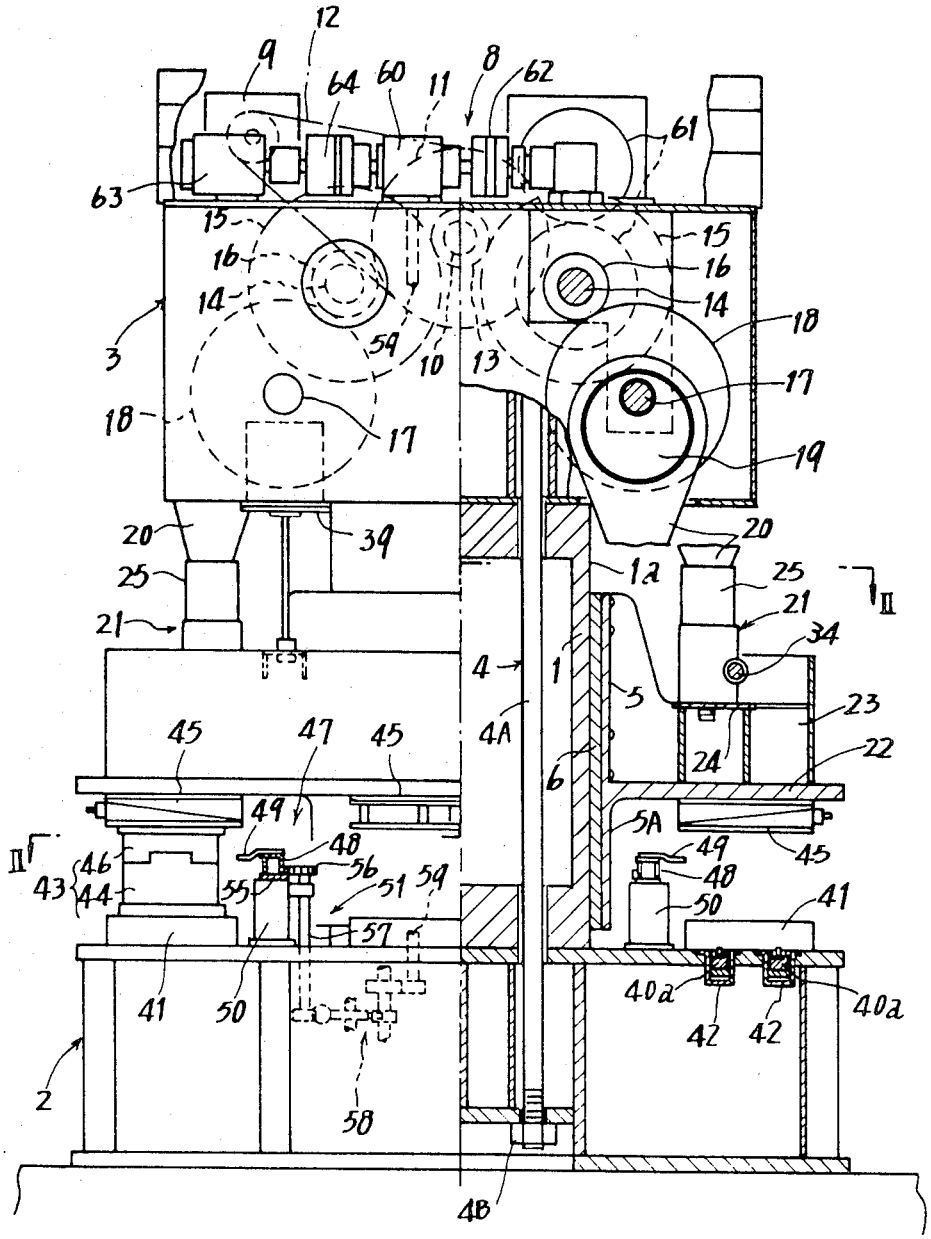
FIG. 1 is a front view partly broken away and showing an embodiment of the invention.
Figure 2:
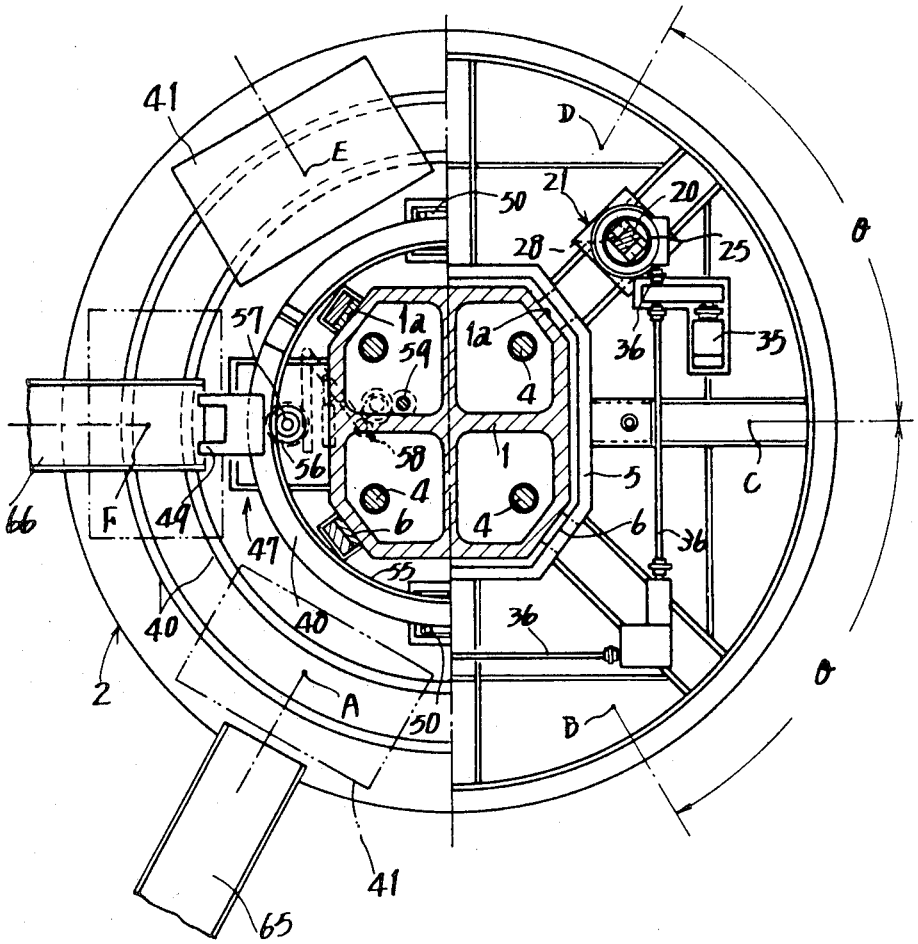
FIG. 2 is a view in section taken along the line II—II in FIG. 1.
Figure 3:
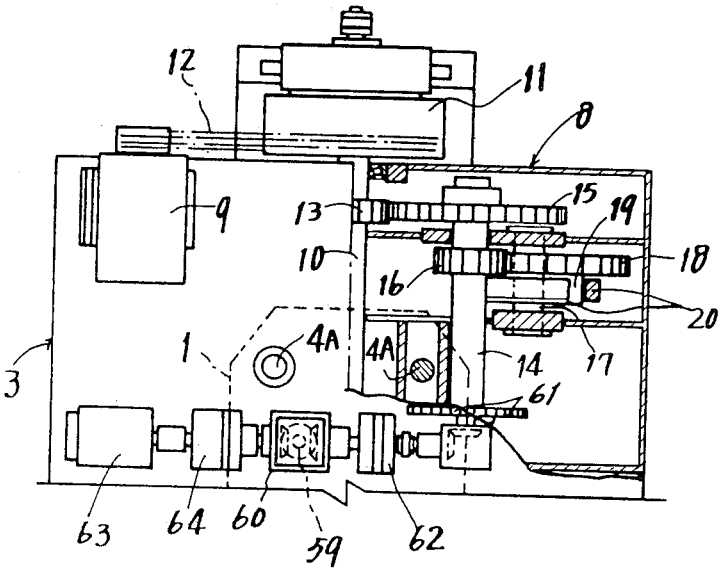
FIG. 3 is a plan view partly broken away.

With reference to FIGS. 1 to 3, indicated at 1 is a post of polygonal cross section mounted in the center of a bed 2. A crown 3 is mounted on the top of the post. Fastening means 4, comprising tie rods 4A extending through the crown 3, post 1 and bed 2, and nuts 4B, fastens the crown 3 and the post 1 to the bed 2. A slide 5 is upwardly and downwardly movable as guided along the post 1 and is in the form of a polygonal tube fitting around the post 1. In other words, the post 1 has an approximately square cross section, includes a side wall at each of the four corners of the square and is therefore octagonal in overall cross section. The four side walls provide guide faces 1*a* as illustrated. Extending downward from the lower end of the slide 5 are legs 5A opposed to the guide faces 1*a*. A guided member 6 in contact with each of the guide faces 1*a* is attached to the inner surfaces of the slide 5 and the leg 5A. The legs 5A and the guided members 6 extend downward to such an extent that they will not strike the upper surface of the bed 2 but can be guided over a sufficient length.

As shown in FIGS. 1 and 3, an assembly 8 for driving the slide 5 upward and downward comprises a main electric motor 9 mounted on the crown 3, a horizontal drive shaft 10 rotatably mounted on an upper portion of the crown 3, transmitting means 12 coupling the main motor 9 to a flywheel and a clutch 11 which are attached to the drive shaft 10, a drive gear 13 mounted on the drive shaft 10, an intermediate gear 15 meshing with the drive gear 13 and mounted on a pair of intermediate shaft 14 disposed on each side of the drive shaft 10 in parallel relation thereto, another intermediate gear 16 mounted on each of the intermediate shafts 14, a main shafts 17 disposed in parallel to the intermediate shafts 14, a driven gear 18 mounted on the main shaft 17 and meshing with the intermediate gear 16, an eccentric wheel 19 mounted on the main shaft 17, a connecting rod 20 having one end fitting around the eccentric wheel 19, and a slide adjusting assembly 21 coupling the other end of the connecting rod 20 to the slide 5. While the pair of slide adjusting assemblies 21 couple the rods 20 to the slide 5 at two locations symmetric with respect to the vertical center axis of the slide 5 in the present embodiment, an increased number of connecting rods 20 may be so coupled, for example, at four locations in accordance with the number.

Figure 4:
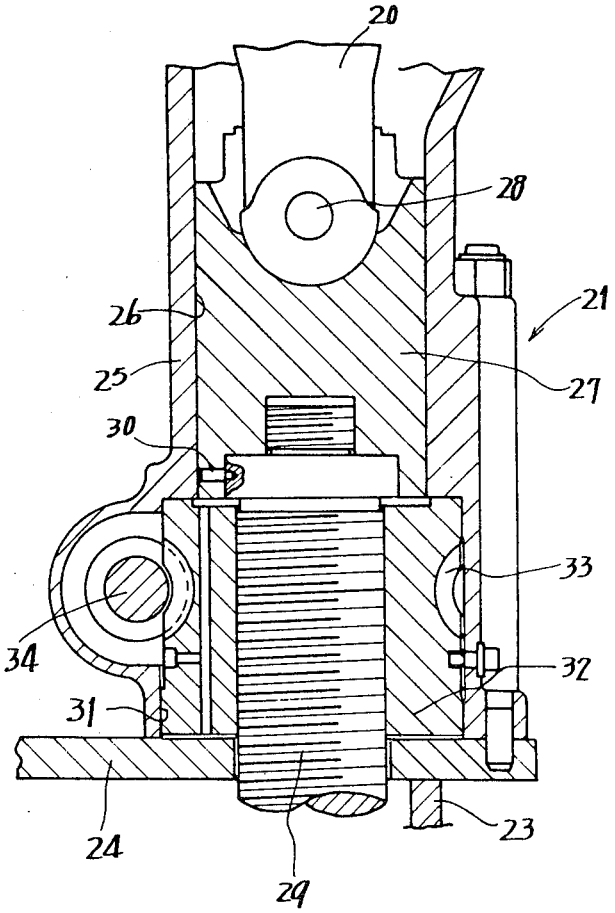
FIG. 4 is a view in vertical section showing a slide adjusting assembly.

The arrangement including the slide adjusting assembly 21 is as follows. With reference to FIGS. 1 and 4, a bottom plate 22 attached to the slide 5 is provided with a frame 23. An upright cylinder 25 is attached to the frame 23 by a support plate 24. A plunger 27 is vertically movable disposed in an upper chamber 26 within the cylinder 25 and connected at its upper portion to the connecting rod 20 by a pin 28. An adjusting screw 29 is screwed at its upper portion into the lower portion of the plunger 27 and held thereto by a setscrew 30. The cylinder 25 has a lower chamber 31 accommodating a nut-like rotatable member 32 screwed on the adjusting screw 29. A worm wheel 33 formed on part of the outer periphery of the rotatable member 32 is in meshing engagement with a worm 34 rotatably supported on the cylinder 25. As seen in FIG. 2, the worm 34 is coupled to a reduction motor 35 by a transmitting shaft 36, etc. Balancers 39 are provided between the crown 3 and the frame 23 as shown in FIG. 1.

Figure 8:
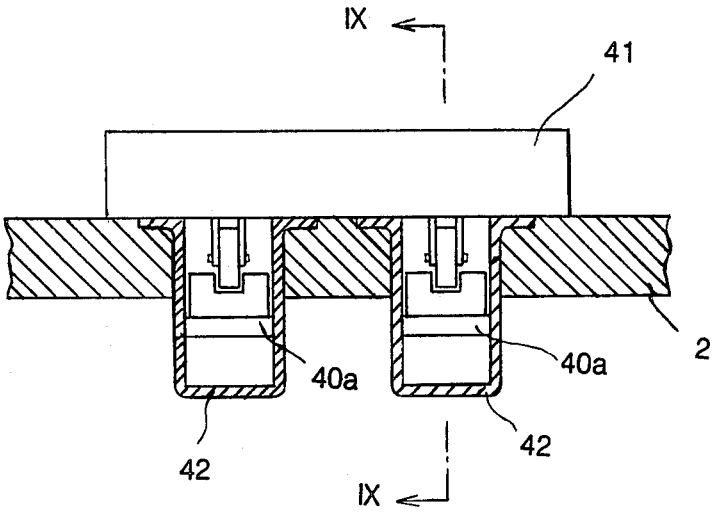
FIG. 8 is an enlarged sectional elevation showing a bolster as lowered in position at one of the stations; and, FIG. 9 is a sectional elevation taken on the line IX—IX of FIG. 8 showing the bolster as raised for transfer.
Figure 9:
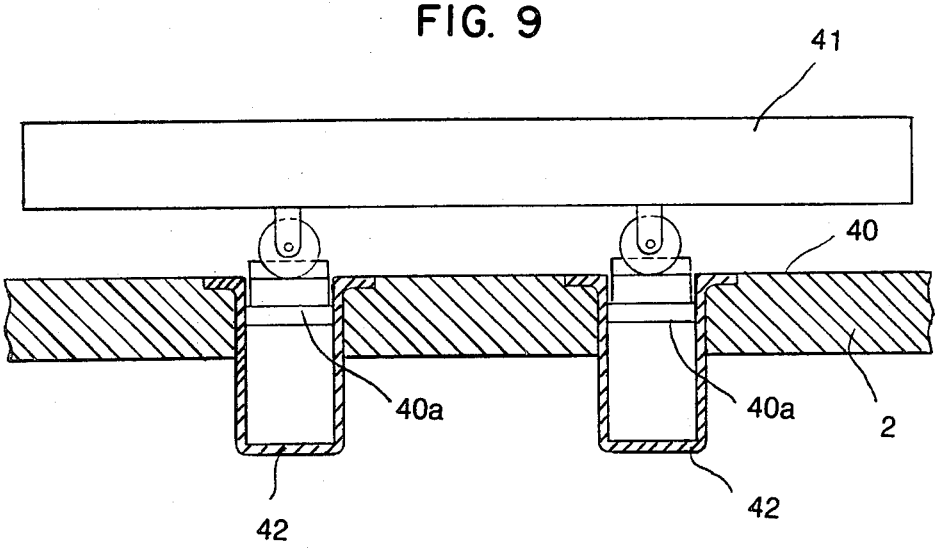

Indicated at 40 (FIG. 2) is an annular guide path which is provided on the bed 2 and along which bolsters 41, each carrying a die for a press work, are movable. The bolster 41 is provided with four wheels. Disposed at each location of the stations on the annular guide path are pistons 40*a* vertically movable in cylinder means 42 and each formed in its upper surface with a groove the bottom surface of which is continuous with the guide path when the piston 40*a* is in its raised position. Thus when the pistons 40*a* are in their raised position, as shown in FIG. 9, the wheels of the bolster 41 are rollable along the annular guide path 40, while when they are in their lowered position, the wheels of the bolster 41 are trapped in the spaced formed above the upper surfaces of the pistons to set the bottom of the bolster 41 in position on the bed 2, namely in a specified station, as shown in FIG. 8. The number of the stations is variable in accordance with the number of press work steps and the size of the equipment. The illustrated embodiment includes six stations A, B, C, D, E and F arranged at a constant angular spacing $\theta$ of 60 degrees. Blanks are fed to the press at the station A, and the products are discharged at the station F, the other stations B to E being working stations. The feed and discharge stations A and F are serviceable also as working stations. Indicated at 43 is a press die mountable on the bolster 41. The die 43 comprises a lower die member 44 attached to the bolster 41 and an upper die member 46 detachably settable on the lower side of the slide bottom plate 22 with a subslide 45.

A transport assembly 47 for conveying workpieces intermittently along the circular path comprises an annular feed bar 48 surrounding the slide 5 and positioned inside the annular guide path 40, workpiece holders 49 mounted on the feed bar 48, members 50 for supporting and guiding the annular feed bar 48, and a feed bar drive mechanism 51 for intermittently turning the feed bar 48. The feed bar drive mechanism 51 for intermittently turning the feed bar 48 in timed relation to the vertical movement of the slide 5 to position the workpiece holders 49 for the corresponding stations A to F comprises a toothed portion 55 formed on the inner side of the annular feed bar 48, a pinion 56 meshing with the toothed portion 55, and means 58 for intermittently rotating a shaft 57 carrying the pinion 56. The rotating means 58 is operatively connected to the vertically driving assembly 8. More specifically stated, a feeding drive shaft 59 serving as an input shaft for the intermittently rotating means 58 extends through the post 1 and is coupled to a gear in a gear box 60 on the crown 3 and further to one of the intermediate shafts 14 by way of a clutch 62 and a train of gears 61 as seen in FIG. 3, whereby the transport assembly 47 is driven in mechanically and completely timed relation to the driving assembly 8 for the slide 5. Alternatively the transport assembly 47 can be operated independently of the driving assembly 8 by an auxiliary electric motor 63 on the crown 3 when the clutch 62 is disengaged, with the torque of the motor 63 delivered to the feeding drive shaft 59 via a clutch 64 and gears in the gear box 60. The term "intermittently turning" means that the feed bar 48 is turned through the specified angle $\theta$ reciprocally or is turned in one direction through the angle $\theta$ at a time. Indicated at 65 (FIG. 2) is a channel for feeding blanks, and at 66 a channel for discharging finished articles.

Figure 5:
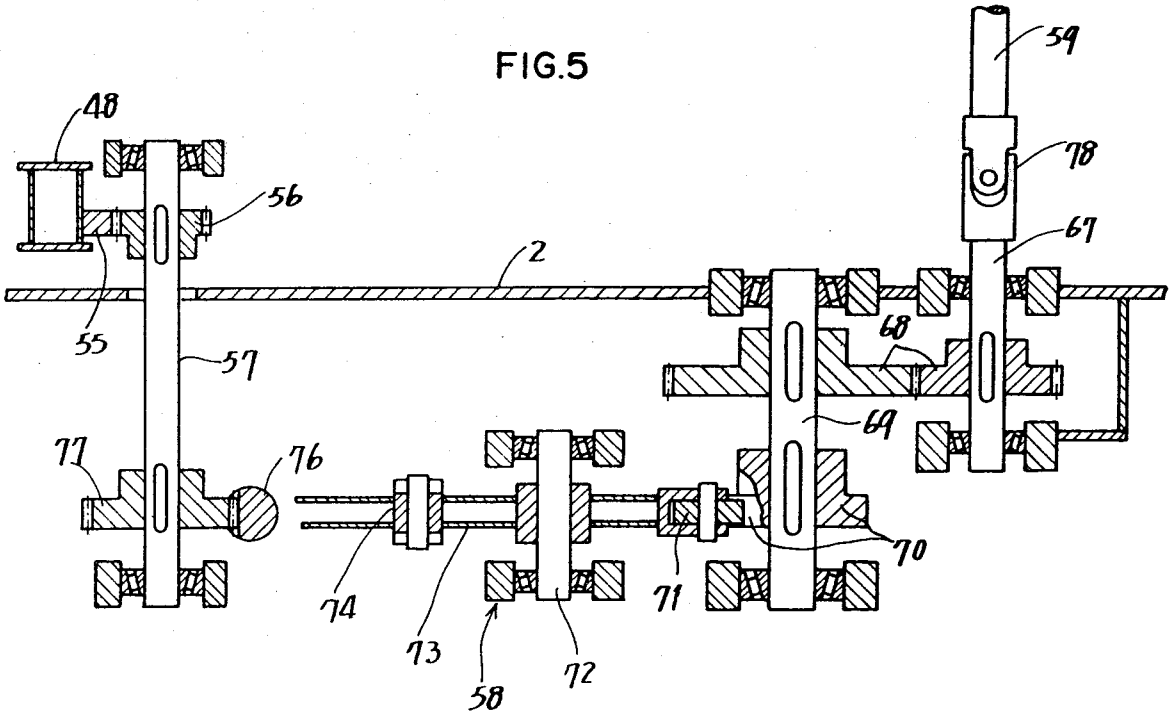
FIG. 5 is a front view in vertical section showing a feed bar drive mechanism.
Figure 6:
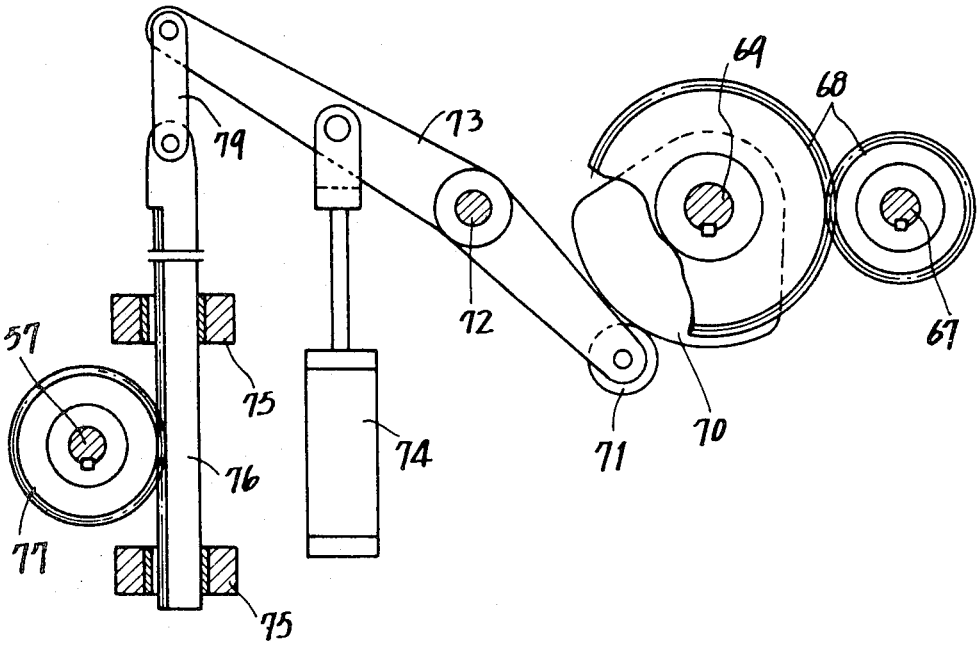
FIG. 6 is a fragmentary plan view partly broken away and showing the same.

As shown in FIGS. 5 and 6, the intermittently rotating means 58 comprises the feeding drive shaft 59, a driven shaft 67 connected to the shaft 59 by a universal joint 78, a cam shaft 69 coupled to the driven shaft 67 by a train of gears 68, a cam 70 mounted on the cam shaft 69, a lever 73 turnably supported by a pivot 72 and having at its one end a cam follower 71 adapted to contact the cam 70, a restraining cylinder 74 for biasing the lever 73 to bring the cam follower 71 into pressing contact with the cam 70, a rack bar 76 linked to the other end of the lever 73 by an arm 79 and slidably supported by bearings 75, and a pinion 77 meshing with the rack bar 76 and mounted on the pinion shaft 57. Thus the rotation of the feeding drive shaft 59 rotates the pinion shaft 57 reciprocally.

The transfer press operates in the following manner.

The press is prepared for operation in the following manner. With the slide 5 held in its upper limit position to form the largest space between the bed 2 and the slide bottom plate 22, the bolsters 41 carrying the dies 43 for press works are set in the corresponding stations on the bed 2, by placing the bolsters 41 into the press through the feed channel 65 one after another and moving the bolsters along the guide path 40 to the specified positions, or by placing the bolsters directly into the corresponding stations from outside with use of a forklift or the like when a sufficient space is available. After the bolsters 41 have been set in position, the slide 5 is lowered to a suitable level, and the upper dies 46 are attached to the subslides 45. Subsequently the lower limit position to which the slide 5 is to be lowered by the driving assembly 8 is adjusted with the slide adjusting assembly 21 by driving the reduction motor 35 (FIg. 2) in the positive or reverse direction to rotate the worm 34, and therefore the rotatable member 32, in the desired direction and thereby moving the adjusting screw 29 in meshing engagement with the member 32 to upwardly or downwardly altering the position of the cylinder 25 relative to the plunger 27. The position of the upper die member 46 and the lower die member 44 relative to each other is thereafter adjusted in each station by the subslide 45.

After the above preparatory procedure, the press is brought into operation. During the rise of the slide 5 (upper die members), a blank is fed to the station A through the feed channel 65, and a finished product is discharged from the station F by way of the channel 67. With the descent of the slide 5, workpieces are pressed at the stations A to F or at the stations B to E. During the subsequent ascent of the slide 5, the workpiece in each of the stations is gripped by the holder 49 and transferred to the next station with the forward turn of the feed bar 48 through the specified angle $\theta$. At this time, another blank is fed to the station A, while a finished article is discharged from the station F as already stated. With the subsequent descent of the slide 5, press works are performed at the stations A to F or B to E. At this time, the feed bar 48 returns through the angle $\theta$ to return the holders 49 to the original positions. It is advantageous to reciprocate the holders 49 in this way when the workpiece is progressively worked and deformed and can not be gripped by the same holder 49. When it is possible to hold the workpiece with the same holder 49 throughout the whole sequence of press works, it is advantageous to intermittently forward the holders 49 in only one direction. In the manner described above, the workpieces are transferred from station to station and subjected to the desired press work at each of the stations.

Blanks can be fed to the press not only through the station A but alternatively also through any other station. The discharge station for the finished articles is not limited to the station F but is changeable depending on the number of press work steps or on what station is used for feeding. When the operation involves a reduced number of press work steps, the die 43 may be removed, for example, from the station E to hold this station out of operation. In view of the motion of the feed bar 48, the station E may then be provided with a support for the workpiece.

Figure 7:
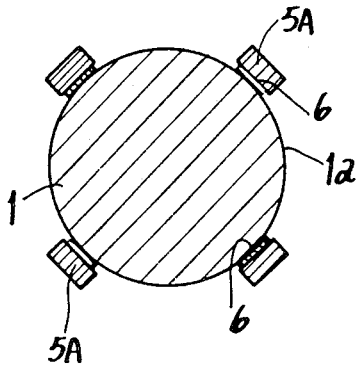
FIG. 7 is a cross sectional view of a post according to another embodiment.

As seen in FIG. 7, the post 1 can be circular in cross section. Thus a hollow or solid cylinder is usable as the post 1.

What is claimed is:

1. A rotary transfer press comprising a bed; a post mounted upright on the bed, a slide upwardly and downwardly movable as guided along the post; a vertically driving assembly for moving the slide upward and downward; a plurality of working stations disposed in a circular arrangement and each provided with a pair of press dies; an annular feed bar extending in the vicinity of the working stations, said feed bar being provided with a toothed portion therealong; and a feed bar driving mechanism comprising a feeding drive shaft mechanically connected to and rotated by the vertically driving assembly, cam means actuated by the rotation of the drive shaft, a lever actuated and rocked by the cam means, a rack bar connected to and moved reciprocally linearly by the lever, a gear mounted on a shaft and meshing with the rack bar, and a pinion mounted on the same shaft as said gear and meshing with the toothed portion of the feed bar, whereby the rotation of the feeding drive shaft is transmitted to the feed bar as an intermittent reciprocal turning motion.

2. A rotary transfer press as defined in claim 1 wherein a crown is mounted on the post, and the crown, the post and the bed are fastened together by means comprising nuts and tie rods extending through the three fastened components.

3. A rotary transfer press as defined in claim 1 wherein the post is polygonal in cross section and has side surfaces for guiding the slide.

4. A rotary transfer press as defined in claim 1 wherein the post is circular in cross section.

5. A rotary transfer press as defined in claim 1 wherein the slide driving assembly comprises a main electric motor, means for transmitting the torque of the motor, a pair of eccentric wheels rotatable by the torque delivered thereto from the transmitting means, a connecting rod having one end fitting around each of the eccentric wheels, and a slide adjusting assembly coupling the other end of the connecting rod to the slide for adjusting the lower limit position of the slide.

6. A rotary transfer press as defined in claim 1 which comprises bolsters each adapted to be provided with one of said pair of dies and moved along an annular guide path extending through the working stations with said pair of dies placed thereon.

7. A rotary transfer press as defined in claim 6 wherein in corresponding relation to each of the stations, the bed is provided with upwardly and downwardly movable members each formed with a groove, the groove having a bottom surface continuous with the annular guide path when the member is in its raised position, each of the bolsters having wheels rollable on the annular guide path so as to travel on the guide path when the members are in their raised position, the bolster being settable in position on the bed with its wheels trapped in spaces above the grooves when the members are in their lowered position.

* * * * *